US006334696B1

(12) United States Patent
Tsao

(10) Patent No.: US 6,334,696 B1
(45) Date of Patent: Jan. 1, 2002

(54) MULTIPLE-PURPOSE CONTAINER COMBINED WITH LANTERN

(76) Inventor: Chung-Piao Tsao, 4F. No. 22, Lane 346, Kuang-Fu S. Road, Taipei (TW)

( * ) Notice: Subject to any disclaimer, the term of this patent is extended or adjusted under 35 U.S.C. 154(b) by 0 days.

(21) Appl. No.: 09/664,924

(22) Filed: Sep. 18, 2000

(51) Int. Cl.[7] ..... F21V 33/00

(52) U.S. Cl. ..... 362/154; 362/399

(58) Field of Search ..... 362/154, 156, 362/399, 124, 808; 299/117.14, 117.09, 117.15, 125.015, 125.15, 117.29

(56) References Cited

U.S. PATENT DOCUMENTS 5,275,331 A * 1/1994 Chung-Piao ..... 229/117.15
6,036,085 A * 3/2000 Chung-Piao ..... 229/117.14

* cited by examiner

*Primary Examiner*—Alan Cariaso
*Assistant Examiner*—Hargobind S. Sawhney

(57) ABSTRACT

A container includes an illuminator fastened in the container for forming a lantern carried for illumination at night time, and a cover hingedly secured to the container and openable for collecting candies, foods, miniature commodities and documents in the container through an opening between the cover and the container, thereby providing a multiple-purpose container.

8 Claims, 4 Drawing Sheets

MULTIPLE-PURPOSE CONTAINER COMBINED WITH LANTERN

BACKGROUND OF THE INVENTION

U.S. Pat. No. 6,036,085 issued to the same inventor of this application disclosed a portable food container including a side cover hingedly secured to a side wall of a box stored with foods therein. However, the box is not provided with any illuminating means in the box. So, it is not suitable to be used to collect candy, gifts or foods in Halloween since there in no light provided for illumination at night time.

The present inventor has invented a container combined with a lantern especially suitably used for collecting materials at night time.

SUMMARY OF THE INVENTION

The object of the present invention is to provide a container including an illuminator held in the container for illumination at night time, and a cover hingedly secured to the container and openable for collecting candies, foods, miniature commodities and documents in the container through an opening between the cover and the container, thereby providing a multiple-purpose container.

DETAILED DESCRIPTION

Figure 1:
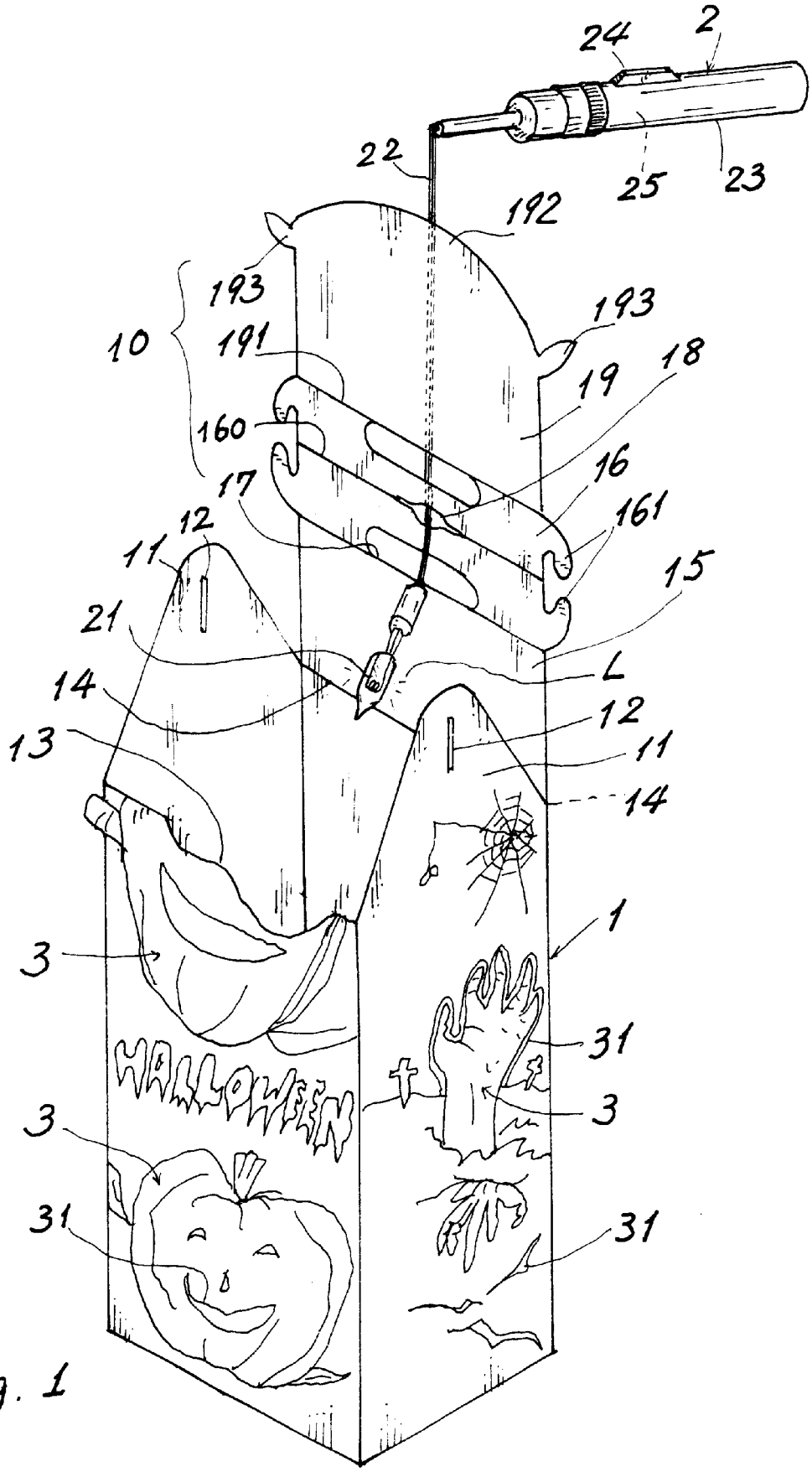
FIG. 1 is an illustration of the present invention when exploded.
Figure 2:
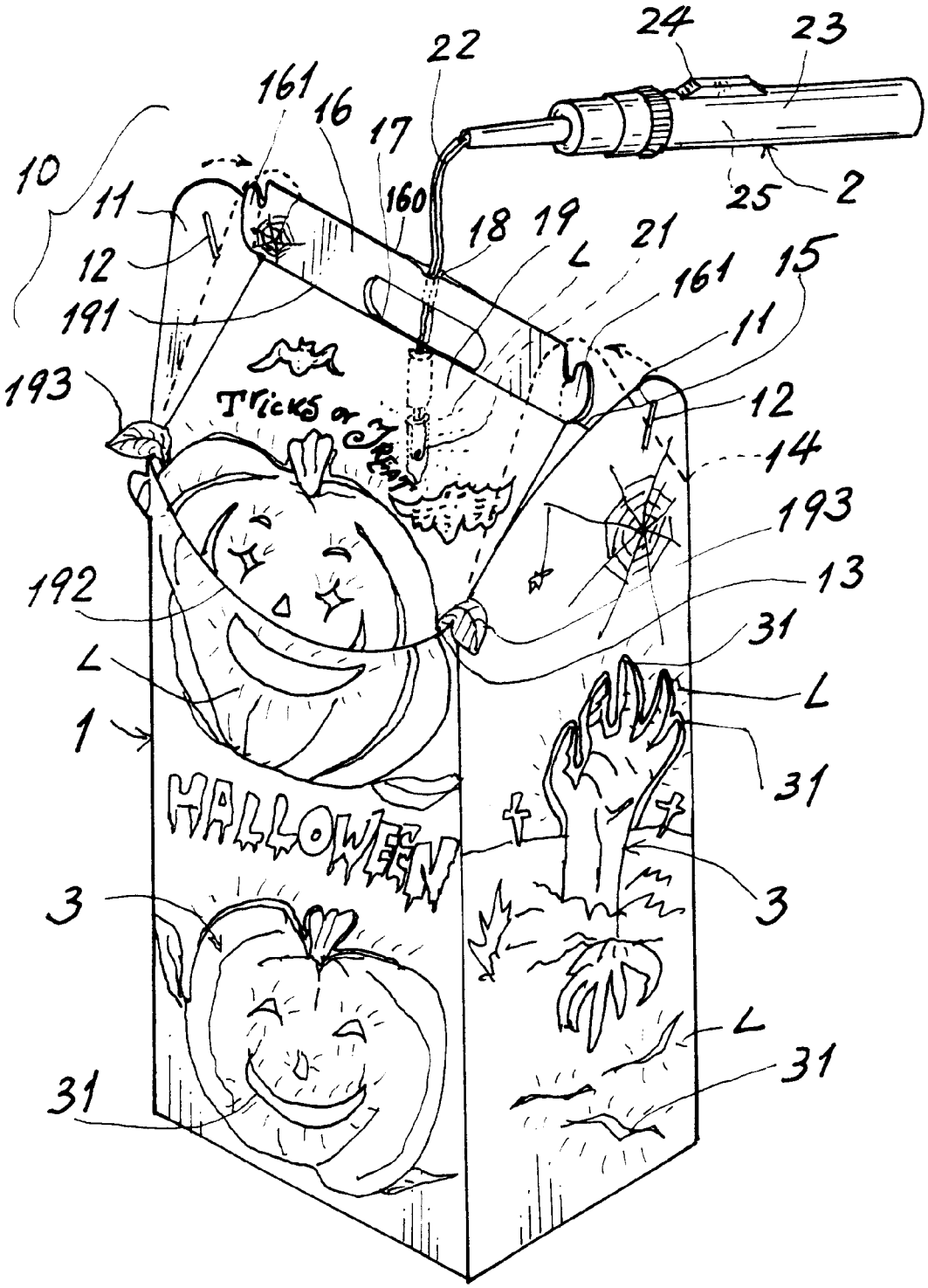
FIG. 2 is an illustration for engaging the hook on the handle with the slit formed in the side lug.
Figure 3:
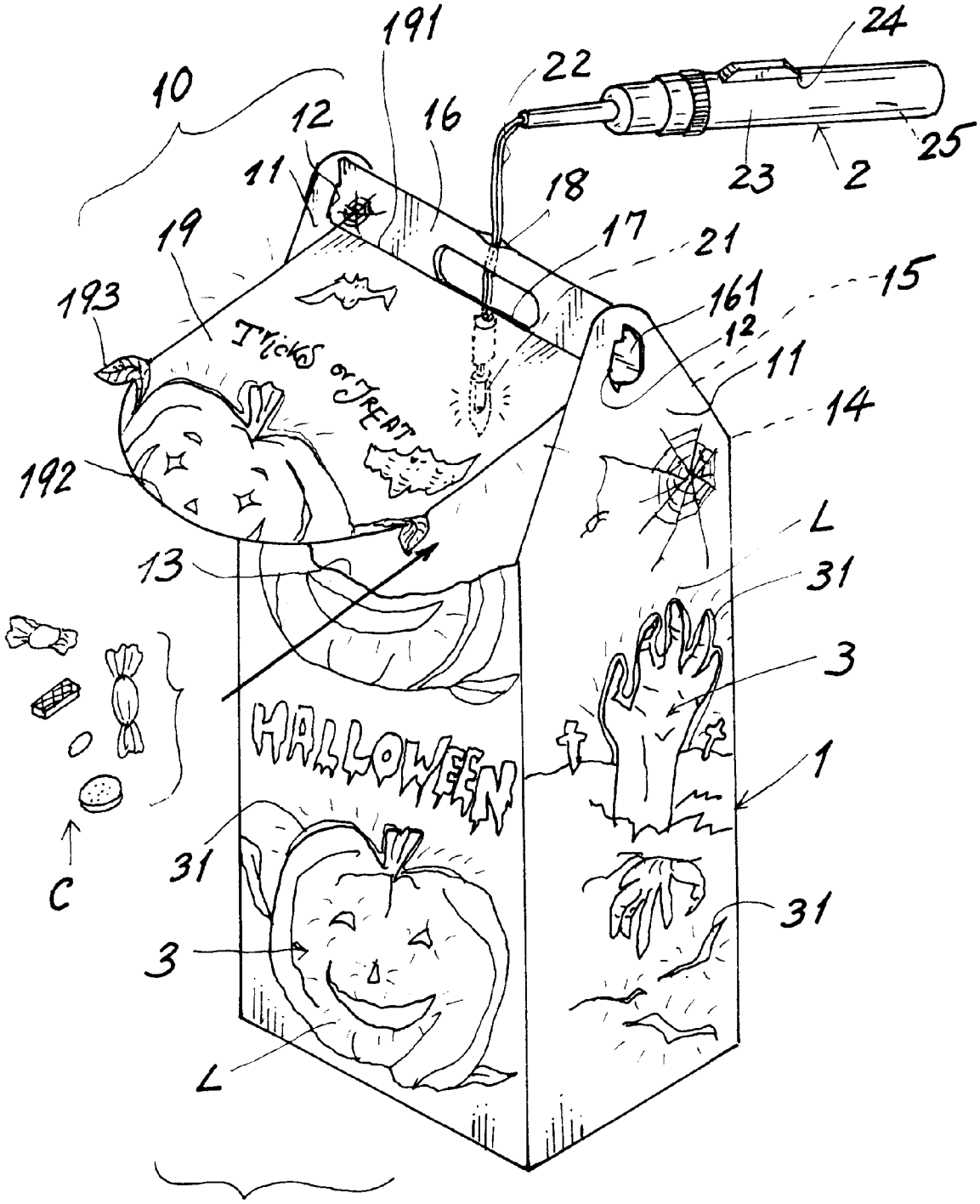
FIG. 3 shows an opening of the cover from the container of the present invention.

As shown in FIGS. 1~3, the present invention comprises: a container 1 printed, painted or formed with decorative features 3 thereon, a pair of side lugs 11 respectively formed on opposite side walls of the container 1 with each side lug 11 formed with an engaging slit 12 therein, a front opening 13 formed in an upper front portion of the container 1 to be filled with candies, foods, miniature commodities, or even documents (receipts, bills, and invoices) into the container through the front opening 13, a rear folding line 14 formed on a rear portion of the container opposite to the front opening 13; a cover 10 hingedly secured to the container 1 for covering an upper portion of the container and including: a rear cover portion 15 hingedly secured to the container 1 by the rear folding line 14, a handle 16 integrally connected to the rear cover portion 15, and a front cover portion 19 integrally connected with the handle 16 and normally covering the front opening 13 and operatively openable for filling materials into the container 1 through the front opening 13; and a lantern device 2 connected with the container 1 for pendently securing the container 1 to the lantern device 2.

The handle 16 is formed by folding and superimposing a pair of handle members which are continuously secured to the rear cover portion 15 when unfolded as shown in FIGS. 1, 2 along a central folding line 160 for carrying the container 1, and is formed with a finger (or hand) slot 17 adapted for inserting the user's fingers or hand for carrying the container 1 if not carried by the lantern device 2.

The handle 16 includes two hooks 161 disposed on opposite ends of the handle 16, each hook 161 formed by folding and superimposing a pair of hook members (from FIG. 1 to FIG. 2), with each hook 161 engaged with an engaging slit 12 formed in each side lug 11 of the container 1 so as to firmly fix the handle 16 in between the two side lugs 11.

Figure 4:
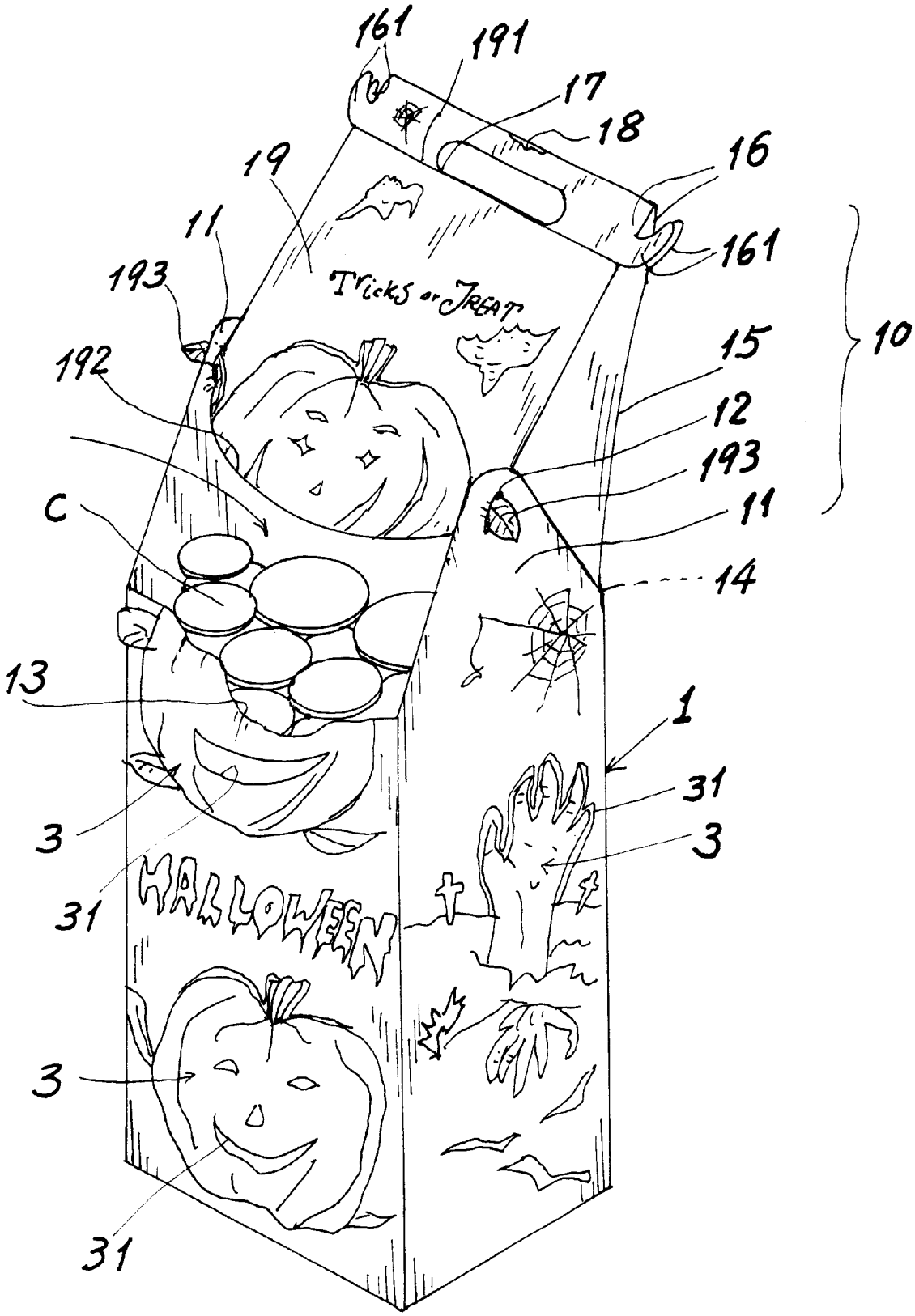
FIG. 4 shows the container of the present invention provided for collecting miniature commodities therein when opening and locking the cover.

The front cover portion 19 is hingedly secured with the handle 16 along a hinge line 191 and further includes a front edge portion 192 for covering the front opening 13 and also serving as a "handle" for opening the front cover portion 19 as shown in FIG. 3 for filling or dropping materials C into the container 1 through the front opening 13, and a pair of locking tabs 193 formed on opposite ends of the front edge portion 192 and engageable with the two engaging slits 12 formed on the two side lugs 11 when retracting the cover 10 rearwardly as shown in FIG. 4 to reveal a big opening adjacent the front opening 13 for depositing coins, miniature commodities, documents including receipts, bills and invoices into the container 1.

The lantern device 2 includes: an illuminator 21 which may be a bulb or a light emitting diode, a pair of electric wires 22 connected between the illuminator 21 and a power source of batteries 25 stored in a grip 23 having a switch 24 formed thereon for switching on or off the power to turn on or off the illuminator 21.

The illuminator 21 is inserted through a central hole 18 formed in a central portion of the handle 16 and is downwardly pulled to allow the illuminator 21 to be fastened between the two handle members of the handle 16, the front cover portion 19 and the rear cover portion 15 so that the illuminator 21 will also serve as a "knot" of a "rope" (the electric wires 22) to be locked in the cover 10 and in the container 1, whereby upon holding of the grip 23 of the lantern device 2, the electric wires 22 between the illuminator 21 and the grip 23 will serve as a "rope" for pendently fastening the container 1 under the grip 23 as shown in FIG. 3.

The container 1 may be printed or formed with decorative features 3 of the Halloween having a plurality of apertures 31 formed in the side walls of the container 1, whereby upon turning on of the illuminator 21, the light L will emit outwardly through the apertures 31 for illumination at night time. Naturally, the light may also partially transmit through the container which may be transparent or translucent if made of paper or plastic sheet materials.

The container 1 may be folded from a one-piece paper board or plastic sheet. The decorative features formed on the container will be brightly shown after being illuminated by the illuminator 21 of the lantern device 2.

In Halloween eve, the kids may carry the present invention to request candies, foods or gifts C which may be filled into the container 1 by the donators. At night time, the child carries the container 1 which is illuminating by turning on the illuminator 21 for a safe walking (for personal and traffic safety).

When the lantern device 2 is not for use, it may be detached from the container 1. The cover 10 is retracted to lock the tabs 193 of the front edge portion 192 of the front cover portion 19 on the side lugs 11 to form an opening for depositing coins or other materials C into the container 1 for storage or display purpose (FIG. 4).

The present invention provides a portable container 1 for filling foods, miniature commodities and documents therein; a lantern device 2 for carrying the container 1 and also for illumination; or simply a container for storage of miniature items.

So, the present invention provides a container for multiple purpose.

The present invention may be modified without departing from the spirit and scope of the present invention.

I claim:

1. A multiple-purpose container comprising:

a container having a pair of side lugs formed on opposite sides thereof each lug formed with an engaging slit therein; and a cover for covering an upper portion of the container including a rear cover portion hingedly secured to a rear portion of the container, a handle integrally connected to the rear cover portion, and a front cover portion hingedly secured with the handle; said handle having a pair of hooks formed on opposite ends of said handle, with each said hook engaged with each said engaging slit for firmly fixing said handle in between said two side lugs of said container to allow the front cover portion to be openable for filling materials, commodities or documents into said container; and a lantern device detachably secured with said container and including an illuminator inserted into said container through said cover, a grip having power source of batteries and switch formed on said grip and a pair of electric wires connected between said illuminator and said grip for pendently securing said container with said lantern device having said illuminator fastened within said container under said cover.

2. A multiple-purpose container according to claim 1, wherein said front cover portion includes a pair of locking tabs on opposite sides of a front edge portion of the front cover portion, said locking tabs operatively engaging with said engaging slits in said two side lugs of said container when rearwardly retracting said front cover portion for forming an opening in an upper front portion of said container for filling materials or documents into said container through said opening.

3. A multiple-purpose container according to claim 1, wherein said illuminator includes a bulb and a light emitting diode.

4. A multiple-purpose container according to claim 1, wherein said handle is formed by folding and superimposing a pair of handle members which are continuously connected to the rear cover portion of said container.

5. A multiple-purpose container according to claim 1, wherein said hook is formed by folding and superimposing a pair of hook members.

6. A multiple-purpose container according to claim 1, wherein said container is printed, painted and formed with a decorative feature thereon, having a plurality of apertures formed in said container for outwardly emitting light of said illuminator.

7. A multiple-purpose container according to claim 6, wherein said container is formed with a Halloween decorative feature thereon.

8. A multiple-purpose container according to claim 1, wherein said handle is formed with a central hole for downwardly passing said illuminator through said central hole into said container to detachably fasten said illuminator under said cover and in said container.

* * * * *